US005406932A

United States Patent [19]

Joseph et al.

[11] Patent Number: 5,406,932

[45] Date of Patent: Apr. 18, 1995

[54] SEALED COMBUSTION RANGE

[75] Inventors: Anthony L. P. Joseph, Etobicoke; John C. K. Overall, Scarborough; Christopher Runcieman, Whitby; Colin Wright, Jackson's Point, all of Canada

[73] Assignee: Canadian Gas Research Institute, Don Mills, Canada

[21] Appl. No.: 965,816

[22] Filed: Oct. 23, 1992

[51] Int. Cl.[6] ..... F24C 3/00

[52] U.S. Cl. ..... 126/39 K; 126/19 R; 126/85 B; 126/15 A

[58] Field of Search ..... 126/39 K, 39 F, 39 H, 126/39 N, 39 J, 85 B, 19 R, 21 R, 15 R, 15 A

[56] References Cited

U.S. PATENT DOCUMENTS

| | | | |
|---|---|---|---|
| 2,870,828 | 1/1959 | Hess | 126/39 N |
| 3,494,350 | 2/1970 | Perl | 126/39 L |
| 3,586,825 | 6/1971 | Hurley | 126/39 J X |
| 3,785,364 | 1/1974 | Reid, Jr. et al. | 126/39 J |
| 3,968,785 | 7/1976 | Perl | 126/39 J |
| 4,067,681 | 1/1978 | Reid, Jr. et al. | 126/39 J X |
| 4,972,823 | 11/1990 | Stadin | 126/39 J X |

FOREIGN PATENT DOCUMENTS

| | | | |
|---|---|---|---|
| 0231333 | 10/1986 | Japan | 126/15 R |

OTHER PUBLICATIONS

"Gas Cooker without Flames", Schott, 1981.

*Primary Examiner*—Carl D. Price
*Attorney, Agent, or Firm*—Bereskin & Parr

[57] ABSTRACT

There is provided a range for sealed combustion of a gaseous fuel comprising a hob assembly and an oven. The hob assembly comprises a glass ceramic cooking surface sealed to a support box and one or more burners. The hob assembly and oven are connected to a fresh air intake/exhaust manifold, such that there is no air exchange between the range and the room in which it is located.

11 Claims, 7 Drawing Sheets

SEALED COMBUSTION RANGE

FIELD OF THE INVENTION

This invention relates to a sealed combustion gas range in which the air required for combustion is drawn from outdoors and all combustion products are vented outdoors and in which there is no air interchange between the range and the structure in which it is located.

BACKGROUND OF THE INVENTION

The development of energy efficient housing technology and the general reduction in air infiltration and leakage in existing North American housing stock have focused public attention on indoor air quality. In older homes, air infiltration, although uncomfortable and energy inefficient, was usually sufficient to dilute any hazardous pollutants generated within the home. However, with tighter home construction, natural air leakage has been reduced to a minimum and, as a result, pollutants generated in the home can accumulate to harmful levels unless a controlled ventilation system is installed.

Conventional domestic gas ranges are designed to be vented to the interior of the structure in which they are located. As a result, the combustion products, which include substances such as carbon dioxide, carbon monoxide, nitrogen oxides and uncombusted fuel, are present in the house. Studies of indoor air contaminants have cited gas ranges as a major contributor to indoor air pollution. Although gas ranges are usually installed with a vent hood, capture of the combustion products by the hood is incomplete. In homes of tight construction, a further concern is the potential depletion of indoor oxygen levels resulting from interior air being used to support the combustion process.

Known in the art are gas ranges in which the burners are located beneath a glass ceramic top, for ease of cleaning and for appearance. However, ranges of this design do not provide for sealed combustion as the air required for combustion is drawn from indoors and the combustion products are vented to the indoors as well. Also known are gas ranges in which combustion products are exhausted through holes in the aeration bowl of the top burners via an exhaust manifold. In these devices, it is intended that the bottom of the cooking vessel being used will provide a sealing of the burners for capture of the combustion products. However, with these devices the capture of the combustion products is not complete, as there can be significant leakage of combustion products around the vessel. In addition, the air for combustion is drawn from inside the house.

SUMMARY OF THE INVENTION

For greater clarity, the term "hob assembly" as used herein means an assembly which includes a surface for supporting a cooking vessel and which includes burners for heating or cooking primarily by radiation and conduction, "oven" means an assembly which includes burners in a closed chamber for heating or cooking primarily by radiation and convection within the chamber and "range" means a combination of a hob assembly and an oven.

According to the present invention, there is provided a range for sealed combustion comprising: (a) a solid heat transfer surface for supporting cooking vessels and transferring heat thereto; (b) at least one hob burner located beneath said heat transfer surface; (c) an oven, including at least one oven burner located therein with each hob burner and the solid heat transfer surface mounted above the oven; (d) means for supplying a gaseous fuel to each burner and connected to each burner; (e) a combustion air inlet, connected to each burner and to the oven, for supplying combustion air to each burner and adapted for connection to an inlet vent located remote from the range connected to the outdoors, for supply of fresh air; and (f) exhaust means connected to each burner and to the oven for exhausting the combustion products from each burner and for preventing air interchange between said range and ambient air, said exhaust means being adapted for connection to an outlet vent opening remotely from the range and to the outdoors.

BRIEF DESCRIPTION OF THE DRAWINGS

For a better understanding of the present invention and to show more clearly how it may be carried into effect, reference will now be made, by way of example, to the accompanying drawings, in which.

DESCRIPTION OF THE PREFERRED EMBODIMENTS

Figure 1:
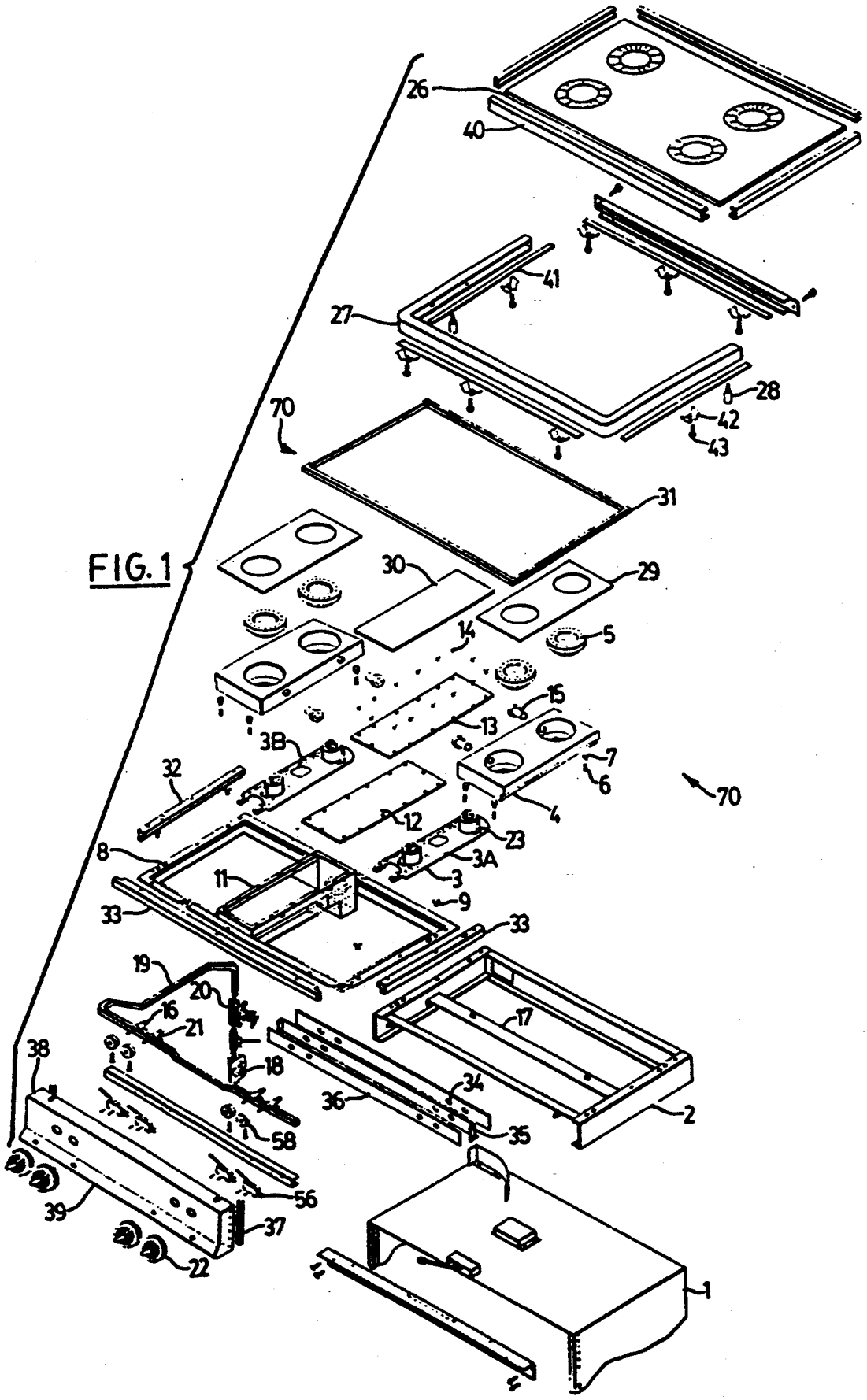
FIG. 1 is an exploded perspective view of a hob assembly according to the present invention.

FIG. 1 shows a hob assembly 70 for installation on a standard gas range 1 or incorporation into a range according to the present invention. Included in the hob assembly 70 are hob burners 3 which are preferably uniburner assemblies, but could also be any type of burners commonly used in advanced technology market ranges, such as sealed or unsealed blue flame or infrared ceramic burners. These type of burners are known in the art, and are typically constructed of brass, iron steel, aluminum, or ceramic or combinations thereof. The hob burners 3 are supported by a support rack 17, which is integral to an air box 2, and also by gas valve orifice hoods 16. The air box 2 also defines a chamber for the flow of incoming combustion air, as will be described below.

The embodiment of the present invention shown in FIG. 1 has four hob burners 3, two of the hob burners 3 located on burner assembly 3A and the other two hob burners 3 located on burner assembly 3B. As such there are two ceramic burner boxes 4 and four ceramic inserts 5 that slip fit into the burner boxes 4 to form combustion chambers for the hob burners 3. Alternatively, the hob assembly 70 may comprise any number of hob burners. The burner boxes 4 and inserts 5 are preferably made from vacuum formed alumina silicate fibres rated at 1260° C., which have been machined and then impregnated with colloidal silica for rigidity.

At each bottom corner of each burner box 4 is a push fit thimble 7 sealed thereto by a high temperature silicone sealant. Affixed in each thimble 7 is a compression spring 6, which ensures that the burner box 4 is in direct communication with the underside of glass ceramic cooking surface 26. Springs 6 are sufficiently compressible to allow the cooking surface 26 to flex should it be subjected to mechanical shocks. Also, springs 6 should not exert substantial upward pressure on surface 26, as such pressure will tend to warp the surface 26.

The burner boxes 4 are fitted directly into a hob chassis 8 as drop-in units. The hob chassis 8 is fastened to the top of the range 1 with an appropriate amount of bolts 9 and nuts (not shown). An exhaust port 11 is located between the two burner boxes 4, and provides for the separation of the burner boxes 4 necessary for proper use of the hob assembly. The burner boxes 4 and the ceramic inserts 5 include passages into which burner exhaust orifice hoods 15 are fitted for exhausting the combustion products from the individual hob burners into the exhaust port 11. The exhaust port 11 is generally box-like and is integral with hob chassis 8. As will be described below, the exhaust port 11 is connected to a central exhaust system which exhausts the combustion products to the outdoors.

The gaseous fuel for combustion in the hob burners 3 is supplied from an external source (not shown) to a gas manifold 19 in known manner. A gas pressure regulator 18 is used to control and maintain a uniform pressure in gas manifold 19. In the embodiment illustrated in FIG. 1, a common gas manifold 19 supplies gas to all four hob burners 3, the gas flow commencing when a solenoid gas valve 20 is energized, the solenoid valve 20 providing on electrically actuated safety valve. However, the gas manifold 19 could also be partitioned such that two or four solenoid gas valves are used to supply the hob burners 3. Such a partitioning has several advantages, as will be outlined below.

In the embodiment shown in FIG. 1, four manually operable hob burner gas valves 21 are installed on the gas manifold 19 at the front of the range 1. The hob burner gas valves 21 extend through a control knob panel 38 and burner control knobs 22 are attached to the portions so extending.

Figure 2A:
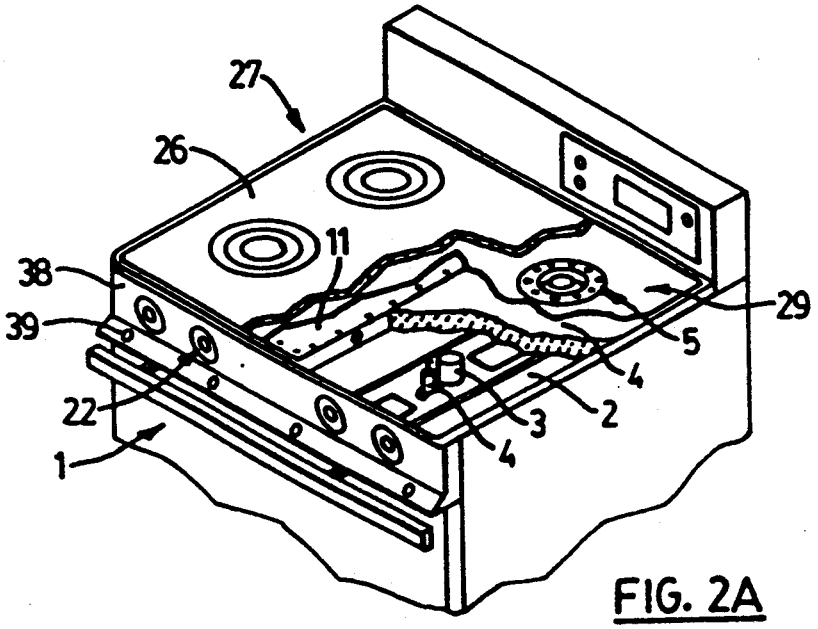
FIG. 2A is a sectional perspective view of the hob assembly of FIG. 1.
Figure 2B:
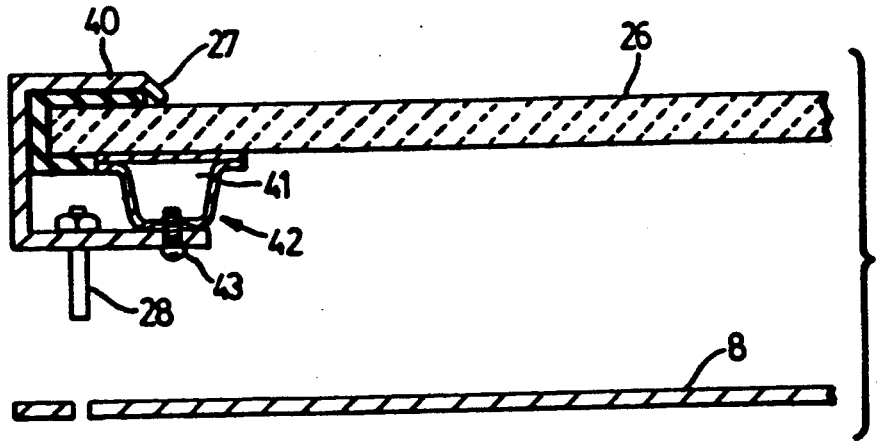
FIG. 2B is a side sectional view of the cooking surface and bezel arrangement of FIG. 2A.

The top of the hob assembly 70 comprises a glass ceramic cooking surface 26. The cooking surface 26 used herein is made of CERAN (trade mark) glass ceramic, manufactured by Schott, Germany,and has a length of 752 mm, a width of 573 mm and a thickness of 4 mm. Glass ceramic as identified above has a high physical strength, a low thermal expansion and good heat transfer characteristics. Prior to being installed in a metal bezel 27, which is preferably aluminum or stainless steel, the circumference of cooking surface 26 is surrounded by a foam rubber strip 40. As is shown in FIG. 2B, cooking surface 26 is secured in bezel 27 by a set of metal strips 41, which surround the bottom of the surface 26 proximate the foam rubber strip 40, compression clips 42 and screws 43. By turning screws 43 such that clips 42 abut strips 41, the bezel 27 can be firmly attached to cooking surface 26. A closed cell foam rubber gasket 31 is attached to the bottom of bezel 27. Gasket 31 forms a seal with metal strips 32, 33, which are attached to chassis 8. The seal so formed prevents room air from entering hob assembly 70.

The cooking surface 26 is positioned on the hob chassis 8 by the use of two locating pins 28, which extend downwardly from bezel 27, each locating pin 28 being adapted to engage a hole located in hob chassis 8. Thus, bezel 27, and hence cooking surface 26, is not mechanically fastened to hob chassis 8, and therefore can be easily removed by lifting, for example if cleaning is desired.

A ceramic fibre paper gasket 29 is placed on top of each burner box 4. The preferred gaskets 29 are those sold under the trade mark FIBERFRAX 970, such gaskets having a composition of approximately 52% $Al_2O_3$ and 48% $SiO_2$ and having a nominal uncompressed thickness of 3.20 mm. When the hob assembly 70 is assembled, the gaskets 29 are compressed between the burner boxes 4 and the cooking surface 26, providing a seal therebetween. Also, the thickness of the gaskets 29 provides a space between the cooking surface 26 and the top of the ceramic inserts 5, which aids in the extraction of the combustion products from the burners 3.

The top of port 11 is covered with a ceramic paper gasket 12 and then a cover plate 13, preferably made of steel, which is fixed to the exhaust port 11 by a sufficient quantity of machine screws 14. The exhaust port 11 is insulated from the heat produced by the combustion of the gaseous fuel by a ceramic insulation blanket 30 placed above plate 13. The ceramic insulation blanket 30 also provides a surface level with the ceramic paper gasket 29.

Rubber gaskets 37 located at each end of the control knob panel 38 aid in sealing the hob assembly 70. A heat shield assembly consisting of a first ceramic blanket 34, a blanket support plate 35 and a second ceramic blanket 36 is installed at the front of the gas manifold 19 to shield the front of the range from the temperatures generated by the hob burners 3.

Figure 7:
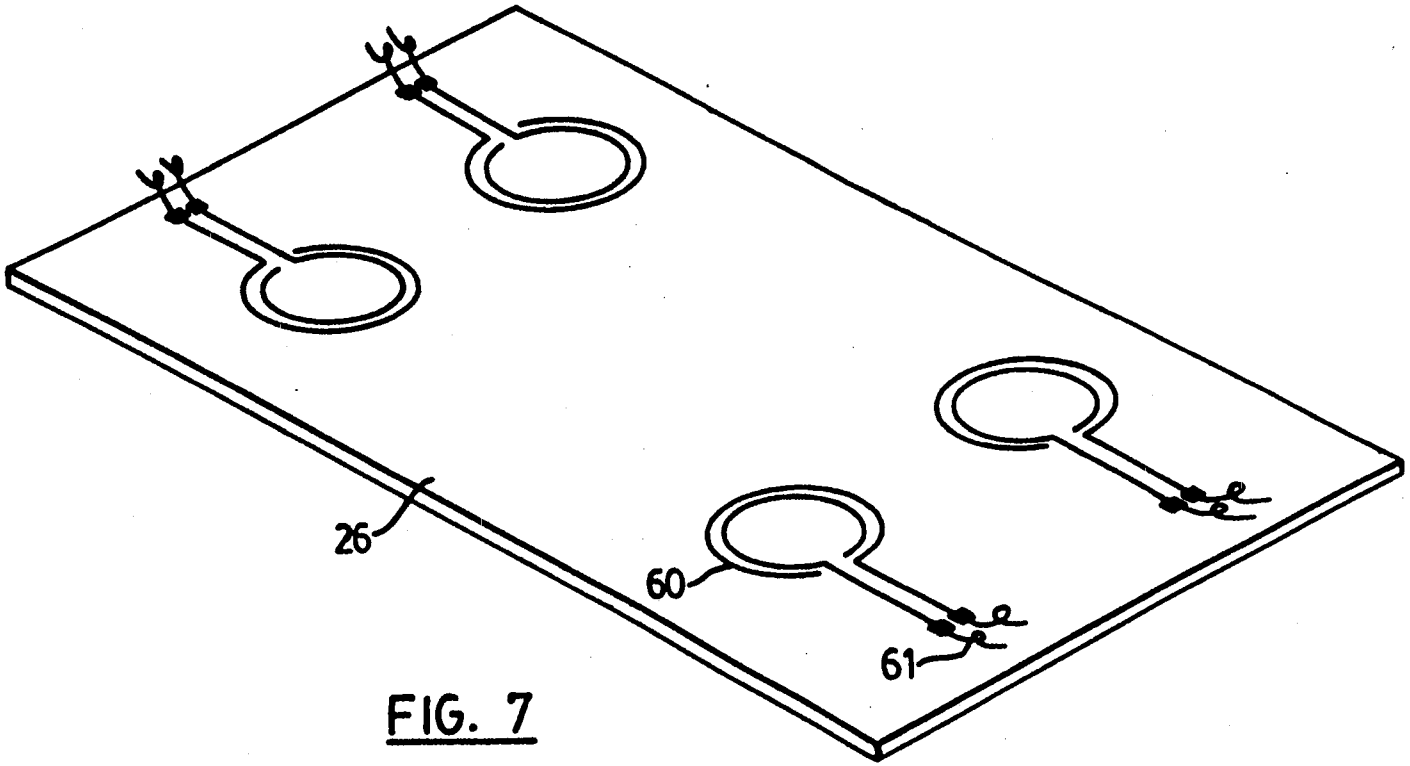
FIG. 7 is a schematic view showing incorporation of the cooking surface thermal protection system of FIG. 6 into a hob assembly.

During normal operation of the hob assembly 70, the ceramic inserts 5 attain temperatures in excess of 600° C. and glow bright red, thereby transmitting radiant energy to the cooking surface 26 and any cooking utensil located thereon. In the preferred embodiment, the surface 26 is protected by a cooking surface thermal protection system. The glass ceramic cooking surface 26 has attached to it pairs of precious metal strips 60 as shown in FIG. 7. Preferably strips of gold with a silver termination are used. As shown in FIG. 7, the precious metal strips of each pair are concentric and define an annulus therebetween. The pairs of precious metal strips 60 are attached to the underside of the cooking surface 26 proximate to the location of the hob burners 3. The strips 60 are attached to cooking surface 26 by screen printing a thin film conductor gold resinate paste containing 15% gold and a small amount of non-precious metals in the form of soluble organometallic compounds. The silver termination is also attached by screen printing, using a silver conductor paste containing 82.2% silver and a small amount of soluble non-precious organometallic compounds. The pastes are then dried at between 80° C. and 100° C. for approximately 20 minutes, and then fired for approximately 2 hours to a peak temperature of 750° C. with a 10 minute soak time. Preferably, the gold portion of strips 60 is 0.1 to 0.3 microns in thickness and the silver termination portion is 10 to 14 microns in thickness.

Figure 6:
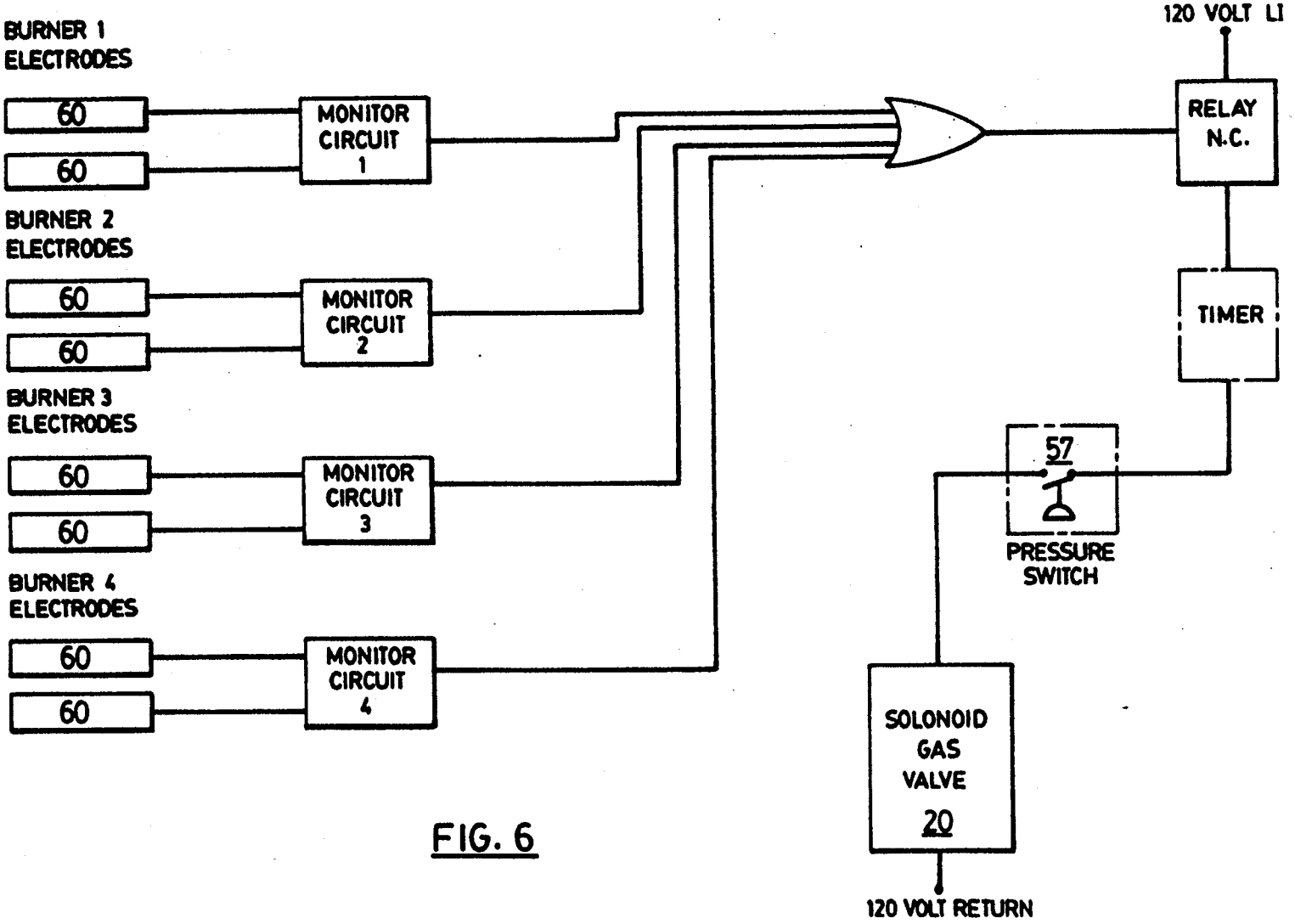
FIG. 6 is a functional block diagram of a cooking surface thermal protection system according to the present invention.

The precious metal strips 60 are connected by high temperature insulated electrical wire 61 to a resistance measuring circuit, of which a functional block diagram is shown in FIG. 6. The resistance measuring circuit measures the resistance of the cooking surface in the annulus between the metal strips in each pair. As stated by the manufacturer of the glass ceramic used herein, the resistance varies with the temperature of the glass ceramic cooking surface 26. The resistance of the annulus between strips 60 is connected in series with a resistance of known value and a voltage applied across this combination. The voltage at the junction is then rectified, filtered and compared with voltages for known temperatures. Should the temperature of the surface 26 as determined by this circuit rise above a predetermined value, the circuit automatically disables the solenoid gas valve 20, shutting off the gas supply to the hob burners 3. Once the temperature of the cooking surface 26 has dropped below the cut-off level, the solenoid gas valve 20 is re-energized to allow burner operation to resume.

Should the hob assembly 70 be fitted with multiple solenoid gas valves 20, as described above, the resistance measuring circuit can be adapted to shut off gas flow to only the burner underneath the area where the temperature of the cooking surface 26 has increased beyond the threshold temperature, thus allowing the other burners to remain in normal operation.

Figure 3A:
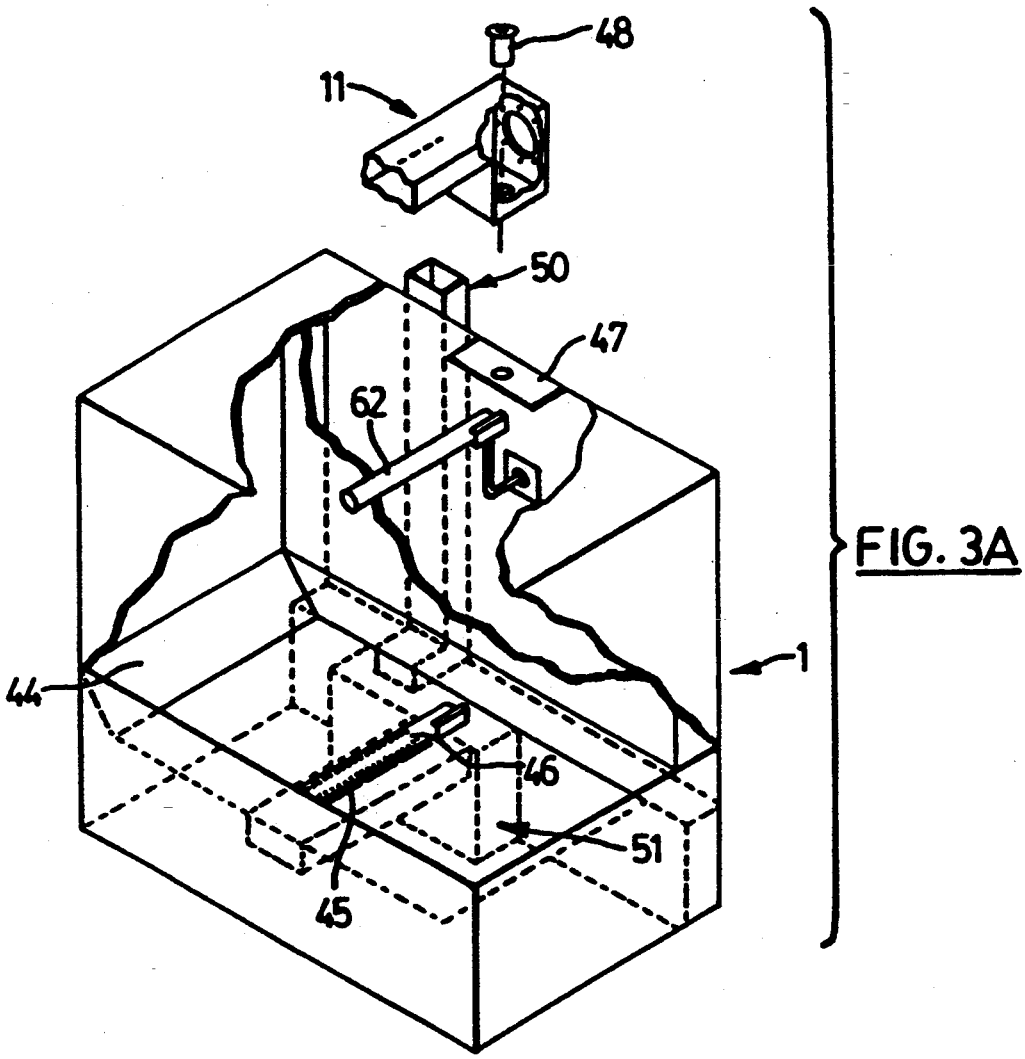
FIG. 3A is a schematic perspective view of an oven according to the present invention.
Figure 3B:
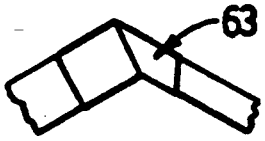
FIG. 3B is a perspective view of a corner seal of the oven of FIG. 3A.

In another embodiment of the present invention, as is illustrated in FIG. 3A, there is provided an oven adapted for sealed combustion. In this embodiment, the corners of the oven box 44 are sealed to prevent any loss of air for combustion to the insulated oven walls. As is shown in FIG. 3B, the corners of the oven box 44 are sealed using angled metal strips 63, which are secured to the oven box 44 by sheet metal screws (now shown). Preferably, a ceramic fibre paper gasket (not shown) is placed between the oven box 44 and the angled metal strips 63. The bottom of the oven box 44 is fitted with a combustion air opening 45 to improve the air distribution along the length of oven bake burner 46.

In the embodiment of FIG. 3A, combustion air for the oven bake burner 46 and the oven broil burner 62 is supplied from a two compartment air intake/exhaust manifold 49 through an air duct 50 located at the rear of range 1. The combustion air then enters an air chamber 51 located beneath the oven box 44 and is distributed via the combustion air openings 45. The oven exhaust is connected directly to exhaust port 11 by means of a flanged plate 47 with an appropriately sized orifice 48 located thereon, as shown in FIG. 3A. The orifice 48 regulates the flow of combustion products from the oven into the exhaust port 11. As will be appreciated by those skilled in the art, the gaseous fuel for combustion is supplied to the oven from an external source (not shown) through a dual thermal bi-metal gas control valve 64, which utilizes a standard gas manifold arrangement.

Figure 4A:
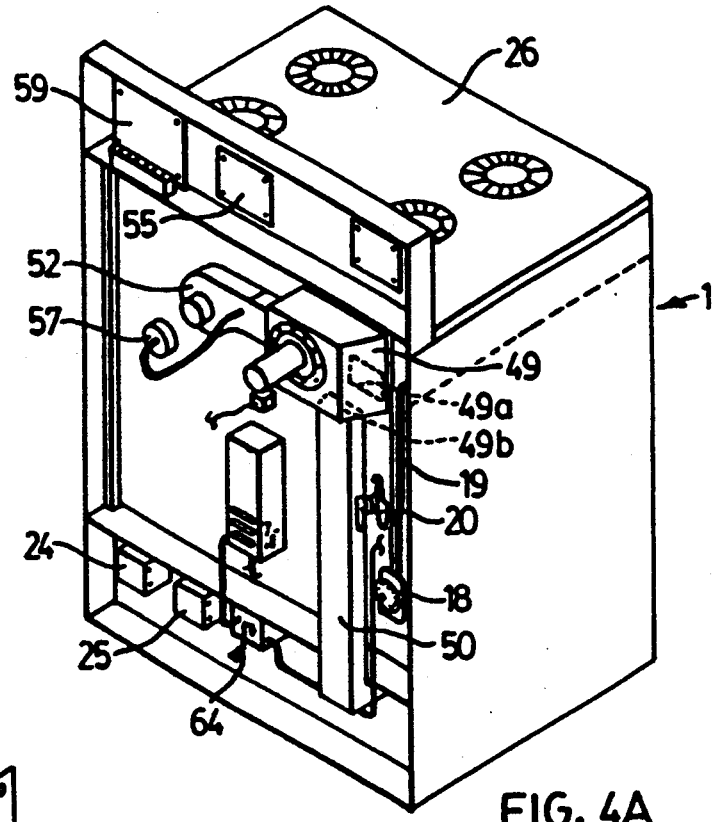
FIG. 4A is a perspective view of the rear of a range incorporating the hob assembly and oven of FIGS. 1 and 3A.
Figure 4B:
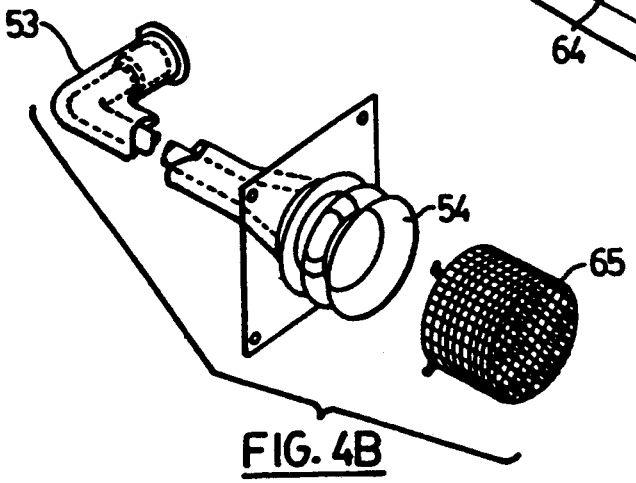
FIG. 4B is a perspective view of a vent system for use with the range of FIG. 4A.

FIG. 4A shows a range according to the present invention which includes both a hob assembly and an oven. In addition to the separate elements of the hob assembly and the oven as described above, this embodiment comprises a centralized air intake/exhaust system.

Figure 4C:
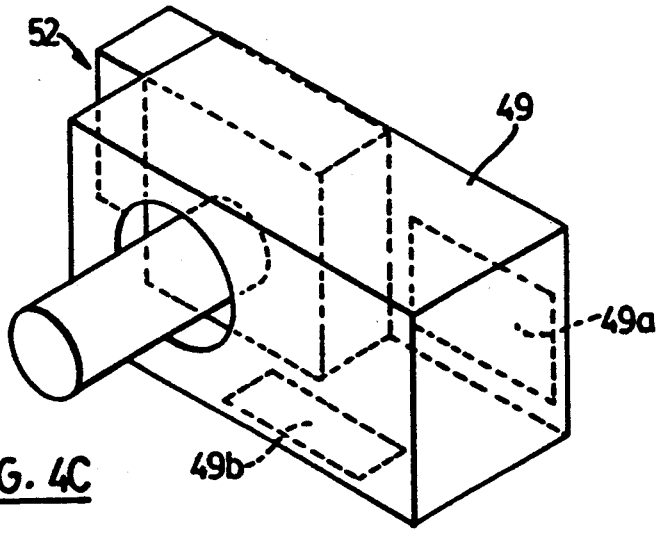
FIG. 4C is a perspective view of the air intake/exhaust manifold of the range of FIG. 4A.

A concentric vent system 53 is used to vent the combustion products to outdoors and to draw fresh combustion air inside from outdoors. In the preferred embodiment, the vent system 53 is fabricated from thin wall stainless steel tubing inside a type B steel vent with a twist lock connection. The vent system 53 terminates outdoors in a vent terminal 54. In the preferred embodiment, the combustion products flow outward through the inner pipe of the vent system 53 while fresh combustion air flows inward through the outer pipe resulting in heat exchange between the two flows which improves the efficiency of the range, while maintaining the exterior of the vent system 53 at a reasonable temperature. Also, in this arrangement the combustion products are completely separated from the fresh combustion air. The vent system 53 is attached to an air intake/exhaust manifold 49 located on the back of the range 1. The manifold 49 consists of two separate compartments coupled together to form a single unit, as is illustrated in FIG. 4C. Air openings 49A and 49B in the manifold 49 distribute combustion air from the vent system 53 to air box 2 and air duct 50 respectively.

Combustion air is supplied to the hob assembly 70 as follows. Combustion air flows from vent system 53 into air intake/exhaust manifold 49, through air opening 49A and into air box 2. The combustion air then flows upwardly through the annulus between the burners 3 and the ceramic insert 5, and is used in the combustion of the gaseous fuel. The combustion products are drawn in into exhaust port 11 and then into the intake of an exhaust blower 52. The outlet of exhaust blower 52 is connected to the exhaust portion of the air intake/exhaust manifold 49 and is then exhausted into the inner pipe of the vent system 53.

Exhaust blower 52 is used to vent the combustion products outdoors. The blower 52 operates at a constant speed and maintains a negative pressure throughout the range. The blower 52 is selected to provide a capacity in excess of the maximum amount of combustion products generated. Such a capacity will also compensate for pressure drops in the vent system, as well as for the effects of adverse weather conditions such as heavy winds.

Figure 5:
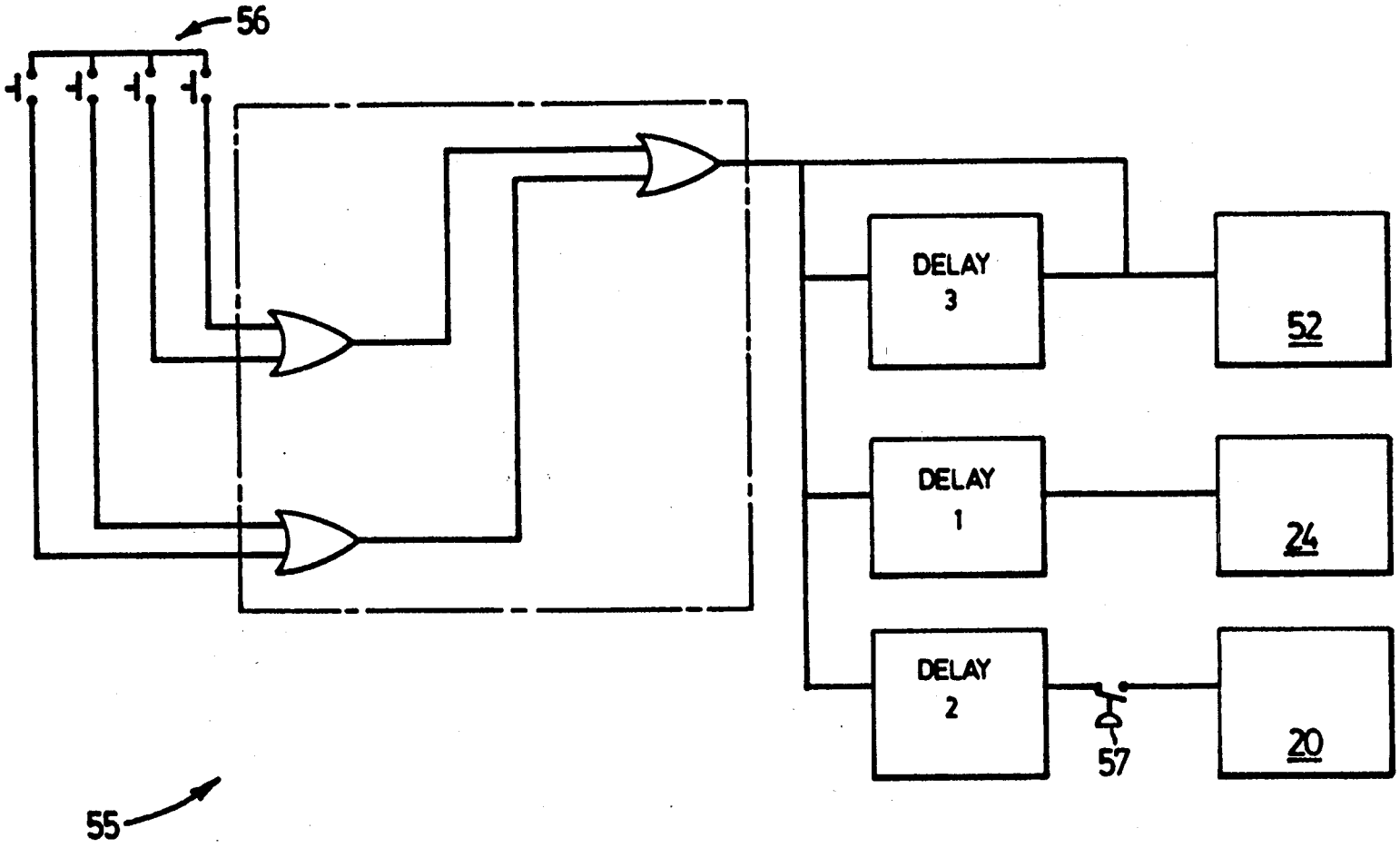
FIG. 5 is a functional block diagram of a control circuit according to the present invention.

The range 1 preferably also comprises a burner ignition and control system. The system comprises a circuit board 55, which incorporates a logic circuit for burner ignition and time delay circuits. A functional block diagram of the circuit board 55 of the preferred embodiment is shown in FIG. 5. When a burner gas valve is turned on, rotation of the respective knob activates a microswitch 56 which signals the circuit board 55, via an OR gate network, to start the exhaust blower 52. This pre-purge of the burner combustion chamber, before the burner is ignited, safeguards against the possibility of a hazard resulting from leakage of gas through the solenoid gas valve when the burners are not in use.

The gas valves 21 are fitted with microswitch activators 58 which activate switches 56 to the closed position when a gas valve control knob 22 is turned to the LITE position. Switches 56 are maintained closed when the burner gas valves 21 are turned down for lower gas inputs to hob burners 3. The switches 56 are electronically interfaced with exhaust blower 52 such that the blower 52 is energized upon any switch 56 becoming activated.

At the end of the pre-purge cycle, timed by DELAY 1 and assuming that at least one gas valve control knob 22 is in the LITE position, the spark ignition module is activated. When a gas valve control knob 22 is in the LITE position or in any other position than OFF, light emitting diodes 39 indicate that the burner is turned on.

The spark electrode assembly 23 is powered by the electronic spark module 24, and is connected therewith by a high temperature insulated electrical wire assembly 25.

After a second preset time delay, DELAY 2, the gas solenoid valve 20 is energized. The circuitry is such that the gas solenoid valve 20 can only be energized when the differential pressure switch 57 has been and is continuously activated. Gas flows, so that a spark from an appropriate spark assembly 23 can ignite the gas.

The circuit board 55 also monitors when all burners in the hob assembly 70 have been turned off and thereupon initiates a preset post-purge cycle. This post-purge cycle is set by DELAY 3, which maintains the blower 52 in operation for a present time after all the microswitches 56 have opened.

If multiple solenoid gas valves 20 are used in the hob assembly 70, the circuit board would be appropriately modified.

While the present invention has been described with reference to certain preferred embodiments, various modifications will be apparent to those skilled in the art and any such modifications are intended to be within the scope of the invention as set forth in the appended claims.

We claim:

1. A range for sealed combustion comprising:

(a) a solid heat transfer surface for supporting cooking vessels and transferring heat thereto;

(b) at least one hob burner located beneath said heat transfer surface;

(c) an oven, including at least one oven burner located therein with each hob burner and the solid heat transfer surface mounted above the oven;

(d) means for supplying a gaseous fuel to each burner and connected to each burner;

(e) a combustion air inlet, connected to each burner and to the oven, for supplying combustion air to each burner and adapted for connection to an inlet vent located remote from the range and connected to outdoors, for supply of fresh air; and (f) exhaust means connected to each burner and to the oven for exhausting the combustion products from each burner and for preventing air interchange between said range and ambient air, said exhaust means being adapted for connection to an outlet vent opening remotely from the range and to the outdoors.

2. A range as claimed in claim 1, which includes an air box, in which each of the burners is supported and above which the solid heat transfer surface is located, the air box defining a chamber through which combustion air flows to each burner and which is connected to the combustion air inlet.

3. A hob assembly as claimed in claim 2, which includes a plurality of burners and wherein the exhaust means includes a common exhaust box located within the air box, and in communication with the burners.

4. A hob assembly as claimed in claim 3, wherein the common exhaust box is centrally mounted within the air box, with at least one burner located on either side of the common exhaust box.

5. A hob assembly as claimed in claim 4, which includes two burner boxes located on either side of the common exhaust box, each of which burner boxes includes at least one opening for a respective burner, and provides an exhaust connection for each burner to the common exhaust box.

6. A range as claimed in claim 5, wherein the solid heat transfer surface comprises a ceramic glass top, wherein the burner boxes are sealed with respect to the ceramic glass top by ceramic paper gaskets, and wherein a ceramic insulation blanket is provided between the exhaust box and the ceramic top.

7. A range as claimed in claim 1, wherein the oven includes a combustion air opening in the bottom thereof and an air duct providing communication between the combustion air opening and the combustion air inlet, and the oven further includes an exhaust outlet at the top thereof, in communication with the exhaust means.

8. A range as claimed in claim 7, which includes a plurality of burners, and which includes an air box in which the burners are located and supported, the air box defining a chamber for supplying combustion air to the burners, and which includes a combustion air inlet manifold, which includes said combustion air inlet, and which is in communication with both the air box and the oven, for supplying combustion air.

9. A range as claimed in claim 8, which includes a vent comprising an outer pipe and an inner pipe located within the outer pipe, the outer pipe forming a duct for incoming combustion air and the inner pipe forming a duct for exhausting combustion products, and wherein the combustion air inlet and the exhaust means comprise a combined inlet and exhaust manifold connected to the vent pipe, the combustion air inlet opening into the outer pipe, and the exhaust means opening into the inner pipe.

10. A range as claimed in claim 9, wherein the exhaust means comprises a common exhaust box located within the air box which is in communication with the burner and the exhaust manifold of the oven and includes a connection between the top of the oven and the bottom of the exhaust box.

11. A range as claimed in claim 10, wherein the exhaust means includes an extraction fan connected downstream of the burners and the oven, the extraction fan exhausting combustion products and providing a flow of combustion air and maintaining a sub-atmospheric pressure within the hob assembly and the oven.

* * * * *